United States Patent [19]

Maledon

[11] 4,449,300

[45] May 22, 1984

[54] HAIR TRIMMING SHEARS

[76] Inventor: Susan D. Maledon, 1224 Warrington, Deerfield, Ill. 60015

[21] Appl. No.: 323,138

[22] Filed: Nov. 19, 1981

[51] Int. Cl.[3] ..... B26B 13/00

[52] U.S. Cl. ..... 30/230; 30/355

[58] Field of Search ..... 30/230, 355, 195, 229

[56] References Cited

U.S. PATENT DOCUMENTS

| | | | |
|---|---|---|---|
| 2,658,274 | 11/1953 | Kane et al. | 30/230 |
| 2,850,803 | 9/1958 | Briskman et al. | 30/230 |
| 3,222,783 | 12/1965 | Kolts et al. | 30/230 |
| 3,817,304 | 6/1974 | Vinh | 30/355 |

*Primary Examiner*—E. R. Kazenske

*Assistant Examiner*—Douglas D. Watts

*Attorney, Agent, or Firm*—Kinzer, Plyer, Dorn & McEachran

[57] ABSTRACT

A pair of hair trimming shears has two pivotally connected blades with integral handles. Each blade carries a plurality of teeth which project upwardly from the surface of the blade; when the blades are closed upon one another, the tooth peaks on one blade engage the roots of the teeth on the other blade in meshing engagement. The teeth are of irregular triangular cross-sectional configuration, which produces a non-uniform, zig-zag cut line that disappears when combed. Thus, the shears permit shortening of hair length without creating undesirably defined cut lines.

5 Claims, 4 Drawing Figures

HAIR TRIMMING SHEARS

BACKGROUND OF THE INVENTION

This invention relates to hair trimming shears for use by barbers, hair dressers and the like. There are three basic types of shears or scissors in common use by barbers and hair dressers, straight-blade shears, curved-blade shears, and thinning shears. Both the straight-blade shears and the curved-blade shears leave a visible cut line, particularly when the barber or hair dresser is cutting or trimming light colored hair (blonde, gray or white). The presence of cut lines creates an undesirable effect with respect to blending, layering and professional appearance of the hair treatment. The thinning shears, which cut some hair but leave other hair completely uncut, are not suitable for shortening the overall length of hair as in either a trim or a cut.

Another type of hair trimming shears is shown in Dahl U.S. Pat. No. 1,903,257. These shears have a plurality of arcuately disposed teeth, concentric with a pivotal connection of the blades. When the blades are closed the hair is grasped between the blades and the result is a cut line which is uneven. The present invention is an improvement on this general type of shears.

SUMMARY OF THE INVENTION

A primary object of the present invention is to provide a pair of hair trimming shears which produces a cut line which is not discernible after combing.

Another object is to provide a pair of hair trimming shears which are effective to reduce or eliminate natural wave effects in hair.

These and other objects are accomplished by a pair of hair trimming shears having two pivotally connected shear blades. Each blade has a plurality of cutting teeth of generally triangular cross-sectional configuration. The teeth extend across the surface of the blade, projecting outwardly from that surface toward the other blade in facing relation with the teeth on the other blade. The teeth of each blade are aligned with the inter-teeth spaces in the other blade in a one-for-one relation for meshing engagement of the teeth on the two blades when the blades are closed on each other. The teeth on each blade have a varying cross-sectional configuration to afford a non-uniform zig-zag trim cut.

DESCRIPTION OF THE PREFERRED EMBODIMENT

Figure 1:
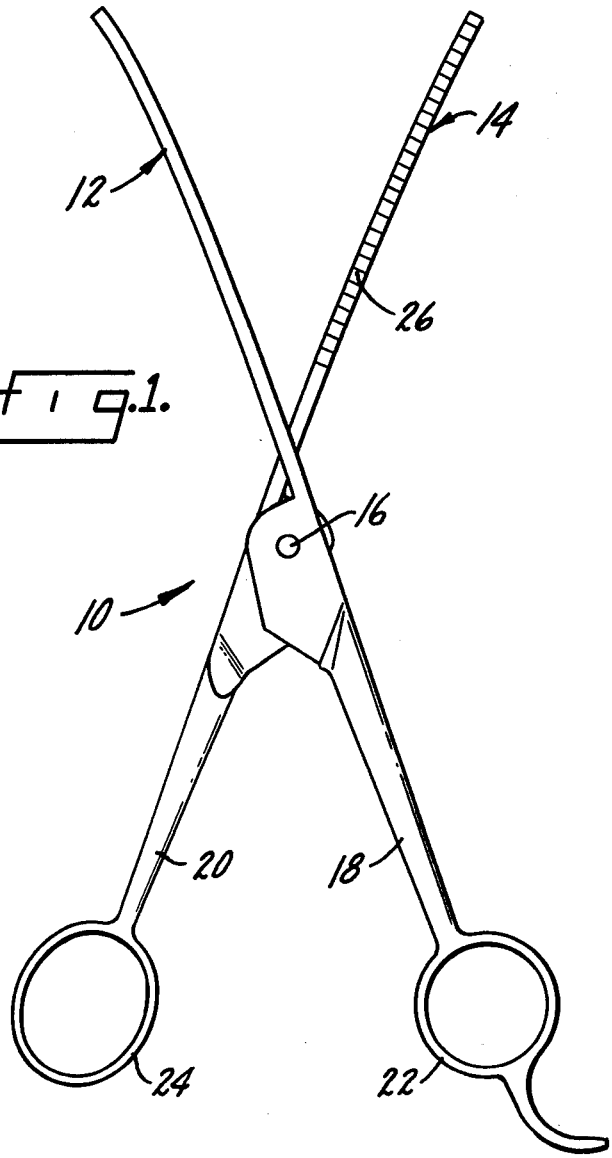
FIG. 1 is an elevation view of a pair of hair trimming shears according to the present invention.

FIG. 1 illustrates a pair of hair trimming shears 10. Two blades 12 and 14 are pivotally connected by a pin 16. The blades include integral handle portions 18 and 20. The handles have the usual finger rings 22 and 24 formed at the ends of the handles. Each blade has a plurality of cutting teeth illustrated at 26. The teeth 26 extend across the surface of each blade and project outwardly from that surface. The teeth of each blade are aligned with the inter-teeth space of the opposing blade. This provides a one-for-one relation between the blades which allows meshing engagement of the teeth when the blades are closed.

The teeth 26 preferably extend across the full width of each of the blades 12 and 14. With narrow blades, this construction affords maximum-length cutting surfaces in shears of minimum weight. Further, each blade is quite narrow, so that the weight of the shears 10 is minimized. Operator fatigue is thereby reduced, making the shears comfortable to use.

The teeth on each blade have an irregular cross-sectional configuration. This affords a non-uniform zig-zag trim cut. The irregular cut line resulting from use of the shears is such that adjacent hairs are cut to varying, different lengths. Consequently, adjacent hairs, when cut, will have different weights, the longer hairs being heavier than the shorter hairs. The longer hair will therefore tend to lay closer to the head, when combed, with each successive hair seeking a natural position different from the adjacent hair. This provides a naturally layered and blended look and eliminates any undesirable distinct cut line.

Figure 2:
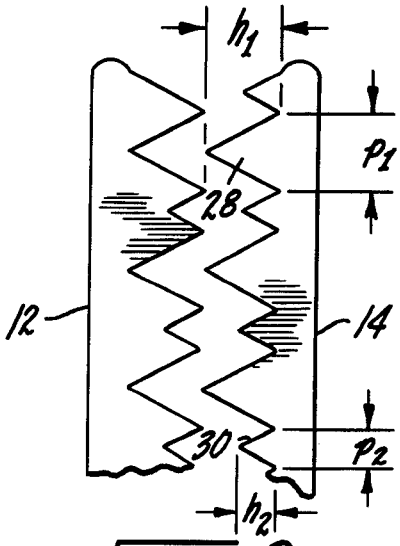
FIG. 2 is an enlarged detail view of a tooth configuration, with the blades being separated for clarity.

FIG. 2 shows one form of tooth cross-sectional configuration. In this embodiment both the tooth height and the tooth pitch are variable but there is a constant ratio between the two. For example, consider the particular teeth shown at 28 and 30. Tooth 28 has a pitch $p_1$ and a height $h_1$. Tooth 30 has pitch $p_2$ and height $h_2$. It can be seen that tooth 28 has both a greater pitch and height than tooth 30. However, the ratio of pitch to height is the same for both teeth, in this case one-to-one.

Figure 3:
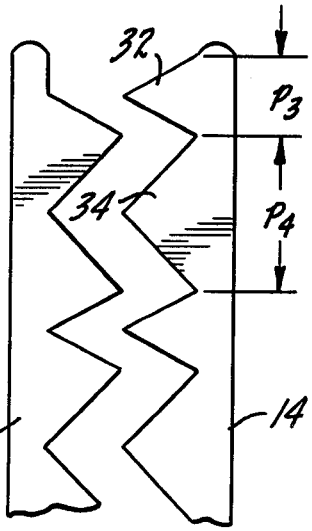
FIG. 3 is a view similar to FIG. 2, showing an alternate tooth configuration.

FIG. 3 shows an alternate tooth configuration. In this embodiment the tooth height is constant while the tooth pitch is variable. This can be seen by examining the teeth 32 and 34. The pitch of tooth 32 is $p_3$ while that of tooth 34 is $p_4$. As is evident from the drawing, these pitch lengths are quite different, while the tooth heights are the same.

Figure 4:
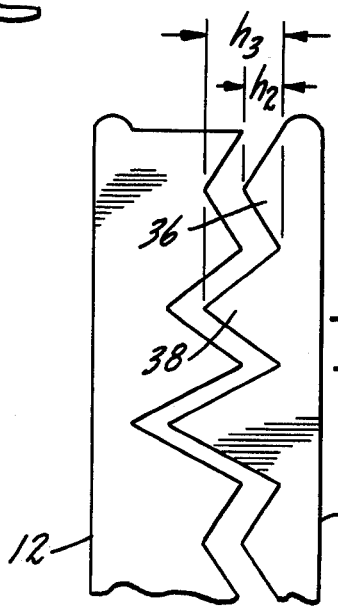
FIG. 4 is a view similar to FIG. 2, showing a further alternate form of tooth configuration.

A further alternate tooth configuration is shown in FIG. 4. Here the pitch of the teeth is uniform while the heights vary. Looking at teeth 36 and 38 in FIG. 4, tooth 36 has height $h_2$ while tooth 38 has a greater height $h_3$.

Any of the illustrated tooth configurations will produce an irregular, zig-zag trim cut. The irregular zig-zag cut afforded by the shears of this invention accentuates the weight differential among adjacent hairs. As explained above, when the hair is combed out the longer hairs, being heavier, tend to lie closer to the head. The result is a shortening of the hair length that does not produce a distinct cut line even with the lightest of hair color. The hair trimming shears have another beneficial effect. When used on wavy hair, they effectively eliminate the wave appearance, following combing, due again to the tendency of the longer hairs to adhere more closely to the skull.

The embodiments of the invention in which an exclusive property or privilege is claimed are defined as follows:

1. A pair of hair trimming shears comprising:

two pivotally connected shear blades, each blade having a plurality of cutting teeth of generally triangular cross-sectional configuration extending across the surface of the blade facing the other blade and projecting outwardly of that surface toward the other blade, the teeth of each blade being aligned with the inter-teeth spaces in the other blade in one-for-one relation for meshing engagement of the teeth on the two blades when the blades are closed on each other, the teeth on each blade being of varying cross-sectional configurations such that each tooth has a different cross-sectional configuration from any adjacent tooth on the blade to afford a non-uniform zig-zag trim cut.

2. Hair trimming shears according to claim 1 in which the ratio of tooth pitch to tooth height is constant but the tooth height varies from tooth to tooth.

3. Hair trimming shears according to claim 1 in which the tooth height is constant but the tooth pitch varies from tooth to tooth.

4. Hair trimming shears according to claim 1 in which the tooth pitch is constant but the tooth height varies from tooth to tooth.

5. Hair trimming shears according to claim 1, claim 2, claim 3 or claim 4, in which each tooth extends across the full width of each blade.

* * * * *